US005951612A

United States Patent [19]

Sahm

[11] Patent Number: 5,951,612

[45] Date of Patent: Sep. 14, 1999

[54] METHOD AND APPARATUS FOR DETERMINING THE ATTITUDE OF AN IMPLEMENT

[75] Inventor: William C. Sahm, Peoria, Ill.

[73] Assignee: Caterpillar Inc., Peoria, Ill.

[21] Appl. No.: 08/690,435

[22] Filed: Jul. 26, 1996

[51] Int. Cl.[6] ..... G05B 19/18

[52] U.S. Cl. ..... 701/50; 364/167.1; 356/138

[58] Field of Search ..... 701/50, 1, 300; 364/167.1; 356/4.08, 27, 141.5, 3.01, 138; 3242/450, 451; 37/348

[56] References Cited

U.S. PATENT DOCUMENTS

| | | | |
|---|---|---|---|
| 3,887,012 | 6/1975 | Scholl et al. | 172/4.5 |
| 3,953,145 | 4/1976 | Teach | 404/84.5 |
| 4,244,123 | 1/1981 | Lazure et al. | 37/348 |
| 4,255,883 | 3/1981 | Ealy | 37/83 |
| 4,273,196 | 6/1981 | Etsusaki et al. | 172/4.5 |
| 4,805,086 | 2/1989 | Nielsen et al. | 364/167 |
| 4,807,131 | 2/1989 | Clegg | 364/424.01 |
| 4,820,041 | 4/1989 | Davidson et al. | 356/1 |
| 4,829,418 | 5/1989 | Nielsen et al. | 364/167 |
| 4,866,641 | 9/1989 | Nielsen et al. | 364/559 |
| 4,888,890 | 12/1989 | Studebaker et al. | 37/438 |
| 4,945,221 | 7/1990 | Nielsen et al. | 250/203 |
| 5,022,763 | 6/1991 | Vuagnat | 356/400 |
| 5,189,484 | 2/1993 | Koschmann et al. | 356/138 |
| 5,375,663 | 12/1994 | Teach | 172/4.5 |
| 5,612,864 | 3/1997 | Henderson | 364/167.05 |

*Primary Examiner*—Tan Q. Nguyen
*Attorney, Agent, or Firm*—Steven D. Lundquist; James R. Yee; Steve L. Noe

[57] ABSTRACT

A method and apparatus for determining at least one of the pitch and slope of an implement on an earthmoving machine. The apparatus includes a mast connected to an upper corner of the implement, a first set of laser detectors connected to the mast, a second set of laser detectors connected to the mast, a third set of laser detectors connected to the mast, and a computer adapted to receive signals from the first, second, and third sets of laser detectors and responsively determine the angle of pitch and the angle of slope of the implement.

12 Claims, 5 Drawing Sheets

METHOD AND APPARATUS FOR DETERMINING THE ATTITUDE OF AN IMPLEMENT

The invention described herein was made in the performance of work under NASA Contract No. NCC2-9007 and is subject to the provisions of Section 305 of the National Aeronautics and Space Act of 1958 (42 U.S.C. 2457).

TECHNICAL FIELD

This invention relates generally to a method and apparatus for determining the position of an implement and more particularly to a method and apparatus for determining the position of an implement relative to a machine.

BACKGROUND ART

Many earthmoving operations require a finished grade or cut that meets strict specifications. One common way of monitoring and controlling this type of earthmoving job is to use a laser generated plane to define the desired finished grade, and to use laser detectors mounted on the earthmoving machine to guide the earthmoving implement in the desired manner in response to the elevation of the laser plane.

In addition to controlling the elevation of the implement relative to the laser plane, other sensors are often used to monitor and control the angle of inclination of the implement relative to the machine. Such sensors are common in the art and include a variety of types of sensors, such as bubble sensors, pendant angle sensors, resolvers, and the like.

As an example of a combination of the above two technologies, in U.S. Pat. No. 4,273,196, Etsusaki et al disclose a system using both laser receivers and inclinometers. The laser receivers control the elevation of an earthmoving blade and the inclinometer measures the tilt of the blade and compares the measured tilt with the desired tilt as selected by the operator.

The use of tilt sensors in addition to the use of laser receivers requires separate sets of components for the laser detection and for the tilt detection. This adds to the cost and complexity of the implement position sensing system. A preferred configuration would be to combine the functions of the two sets of sensors into one set of components.

In U.S. Pat. No. 4,807,131, Clegg discloses a system using two sets of laser detectors mounted at both ends of an earthmoving blade. The system can measure the side to side slope of the blade by comparing the difference in elevation of the two laser receivers, as well as measure the elevation of the blade using the laser system. However, the laser system cannot determine the fore to aft pitch of the blade, so additional pitch sensors are still required.

The present invention is directed to overcoming one or more of the problems as set forth above.

DISCLOSURE OF THE INVENTION

In one aspect of the present invention an apparatus for determining the pitch of an implement on an earthmoving machine is disclosed. The apparatus includes a mast connected to the implement, a first set of laser detectors connected to the mast, a second set of laser detectors connected to the mast, and a computer adapted to receive signals from the first and second sets of laser detectors and responsively determine the angle of pitch of the implement.

In another aspect of the present invention a method for determining the pitch of an implement on an earthmoving machine is disclosed. The method includes the steps of receiving signals from a first set of laser detectors and a second set of laser detectors, comparing the signals from the first set of laser detectors and the second set of laser detectors, and determining the angle of pitch of the implement.

BEST MODE FOR CARRYING OUT THE INVENTION

Figure 1:
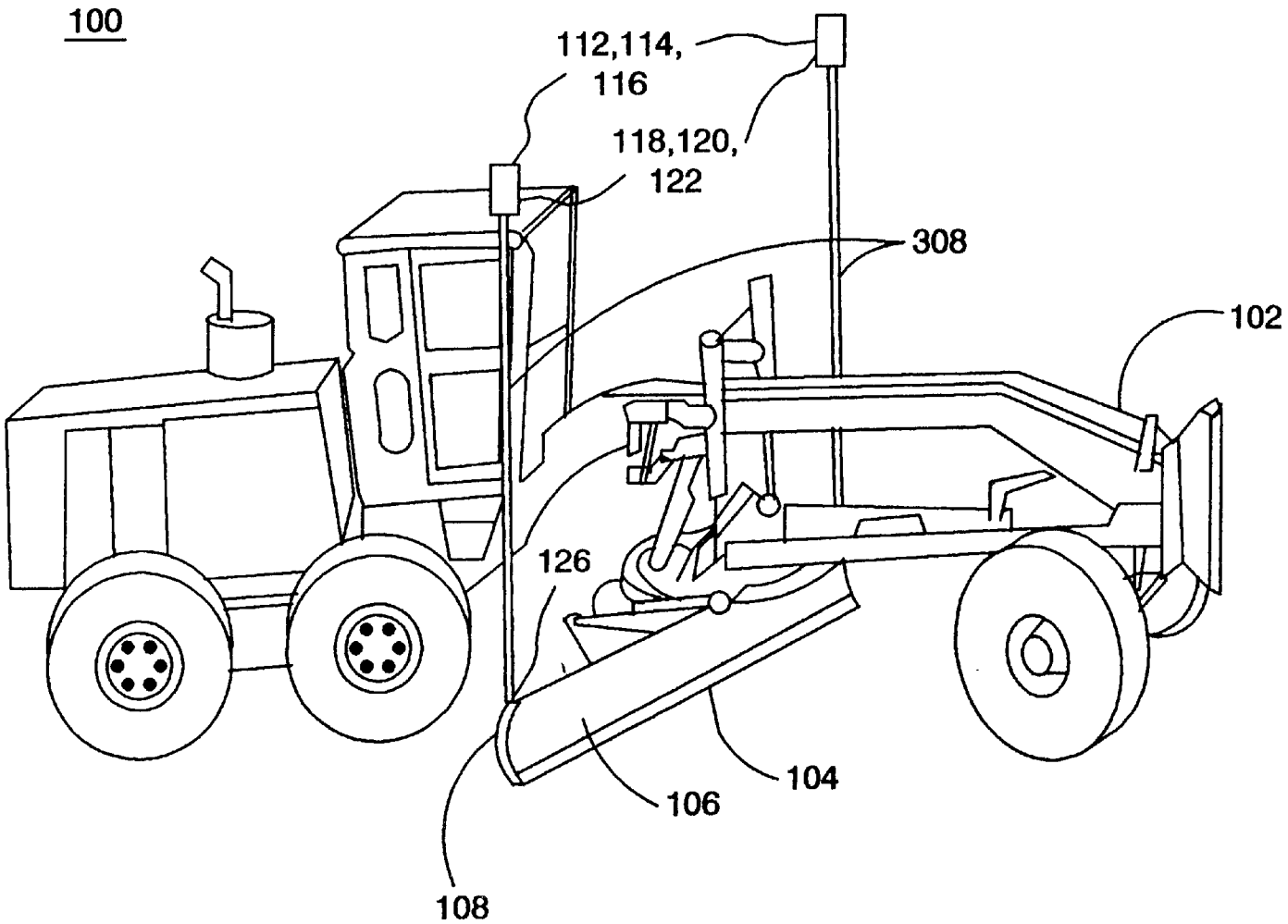
FIG. 1 is a diagrammatic illustration of an apparatus as embodied in the present invention.

With reference to the drawings, and in particular with reference to FIG. 1, a method and apparatus for determining at least one of the pitch and slope of an implement 104 of an earthmoving machine 102 is disclosed. The earthmoving machine 102 shown in FIG. 1 is a motor grader. However, the invention can be applied to other types of earthmoving machines such as track-type tractors, excavators, wheel loaders, and the like.

Figure 5:
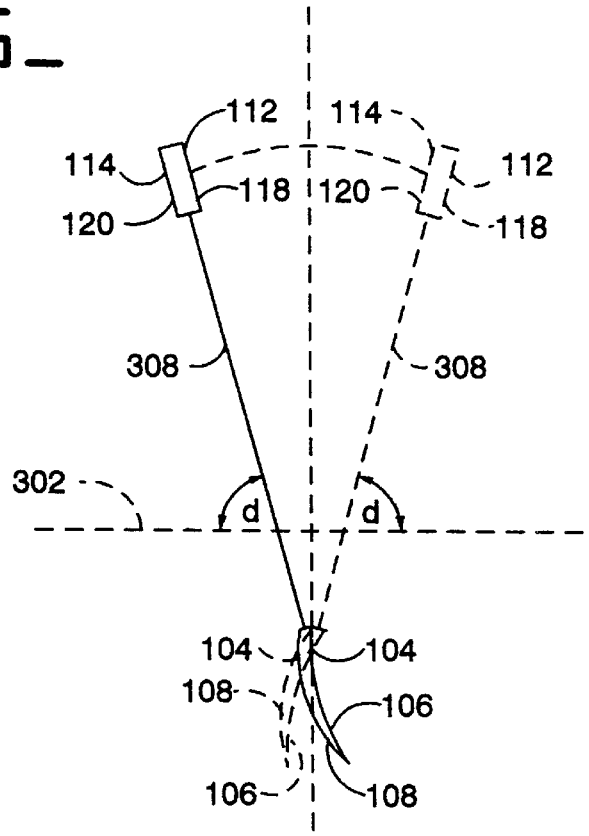
FIG. 5 is a diagrammatic representation of one aspect of the present invention as viewed from a side.

The implement 104 has a front surface 106 and a back surface 108 and is used to scrape or cut the surface of a work area. The implement 104 can be moved in a variety of ways relative to the position of the earthmoving machine 102. For example, the fore to aft pitch of the implement 104 can be controlled, as illustrated in FIG. 5.

Figure 6:
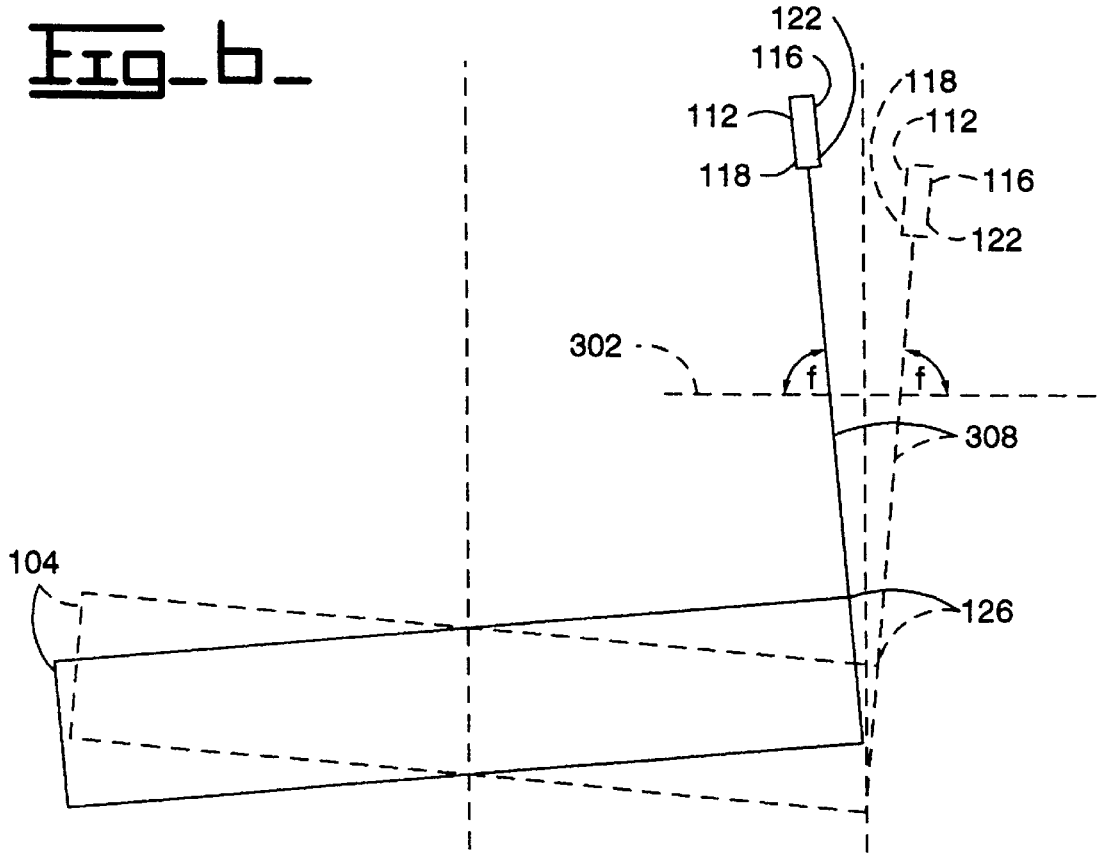
FIG. 6 is a diagrammatic representation of one aspect of the present invention as viewed from another side.

As another example, the side to side slope of the implement 104 can be controlled. This is illustrated in FIG. 6.

The above two examples of implement motion are referred to often in the discussion below and are called pitch and slope, respectively.

Figure 2:
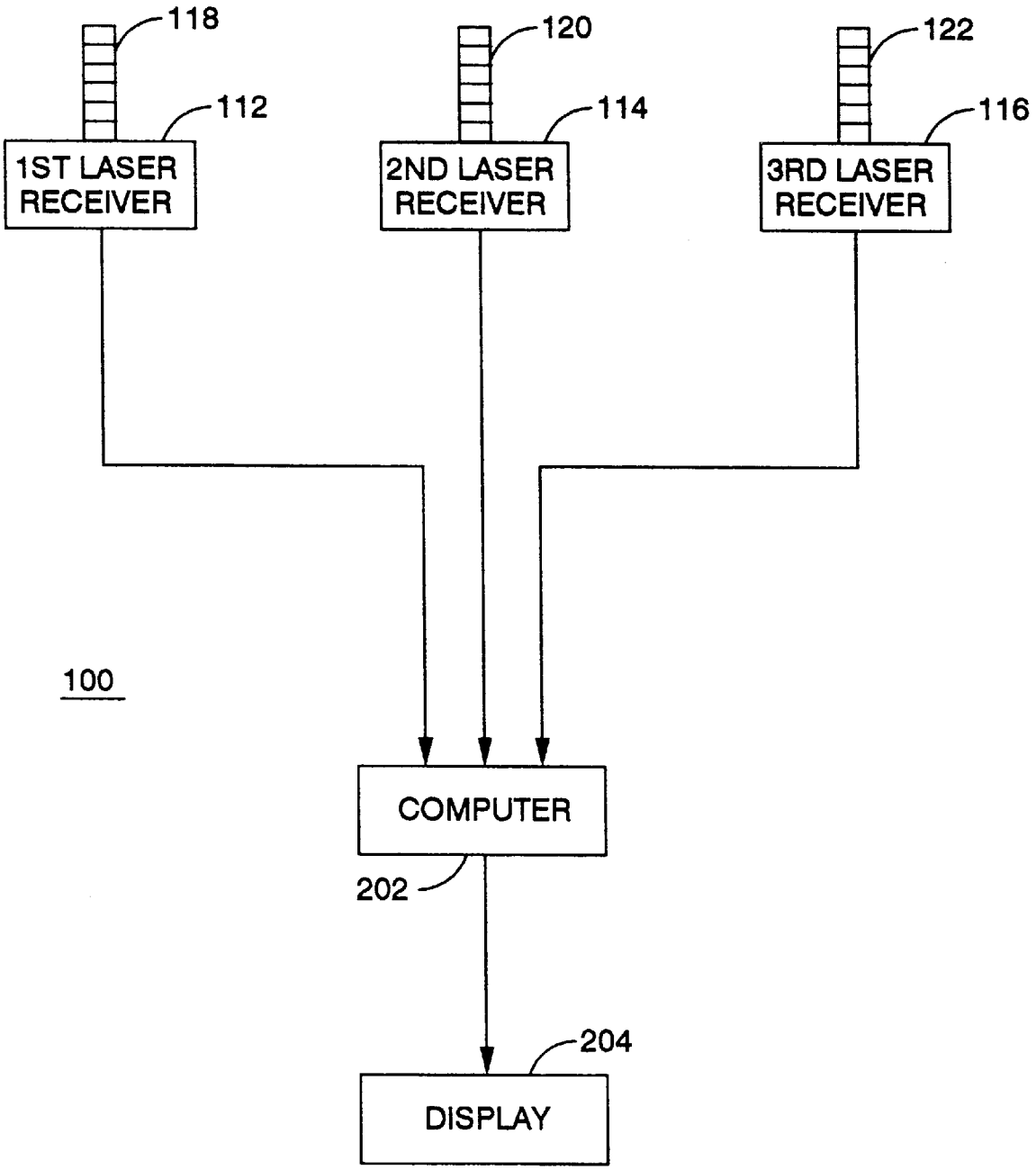
FIG. 2 is a block diagram of an embodiment of the present invention.

Referring to FIGS. 1 and 2, at least one mast 308 is mounted vertically to an end portion 126 of the implement 104. At the top of each mast 308 is mounted a first laser receiver 112, a second laser receiver 114, and a third laser receiver 116.

Laser receivers mounted on masts which are attached to earthmoving implements are common in the art. They are often used to determine the altitude of the implement with respect to the position of the earthmoving machine.

The first, second, and third laser receivers 112,114,116 include first, second, and third sets of laser detectors 118, 120,122, respectively. The first, second, and third sets of laser detectors 118,120,122 are arranged in columns on the mast 308.

Figure 3:
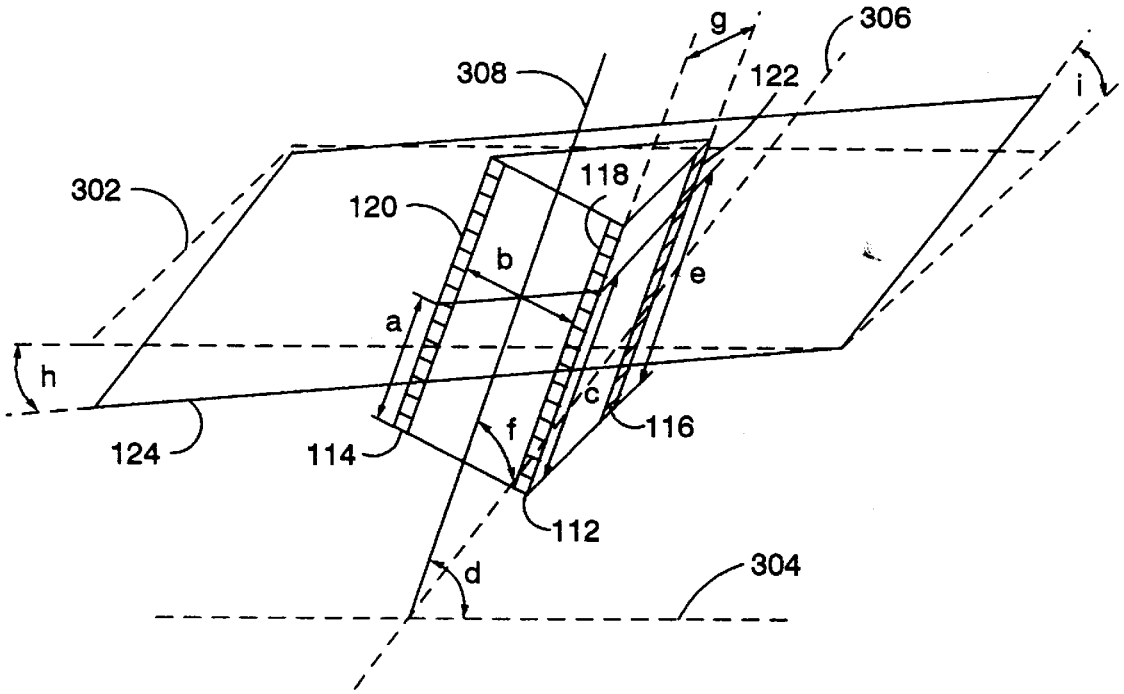
FIG. 3 is a diagrammatic illustration of one aspect of the present invention.
Figure 4:
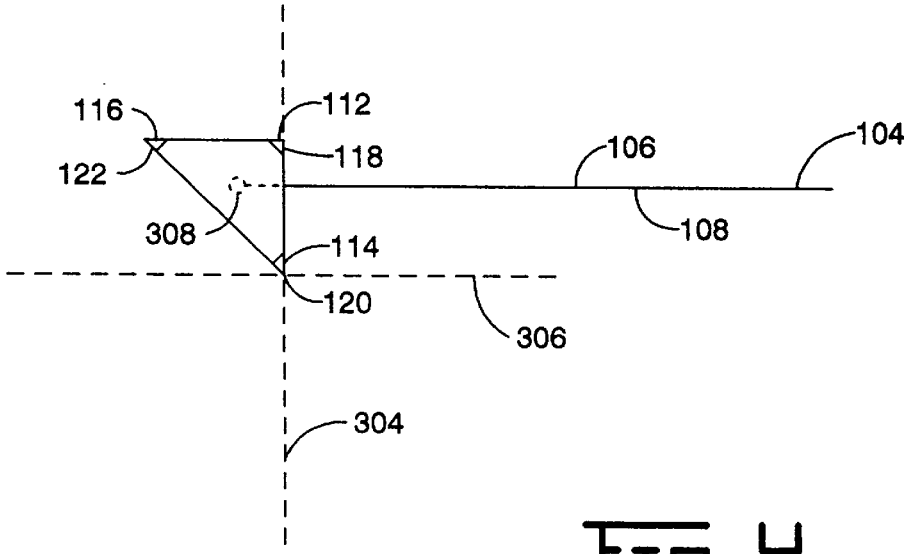
FIG. 4 is a diagrammatic representation of one aspect of the present invention as viewed from above.

Referring to FIGS. 3 and 4, a more detailed explanation of the layout of the first, second, and third sets of laser detectors 118,120,122 will be given.

With reference to FIG. 3, a laser plane 124 is shown. Laser planes are quite often generated horizontally. However, there are many situations where it is desired to generate a laser plane at an angle other than horizontal. For example, it may be desired to grade a work site with a slope to allow rain water to drain off the site to a predetermined location. The laser plane would be generated at the desired slope to provide the implement of the earthmoving machine with a reference.

Laser planes are typically measured with respect to the angle of inclination from horizontal. For example, in FIG. 3 the laser plane 124 inclines an angle h from a reference horizontal plane 302 along a first horizontal coordinate axis 304. The laser plane 124 also inclines an angle i from the horizontal plane 302 along a second horizontal coordinate axis 306 which is horizontally orthogonal to the first horizontal coordinate axis 304. In FIGS. 3 and 4, the first horizontal coordinate axis 304 is defined as a line perpendicular to the implement 104 and the second horizontal coordinate axis 306 is defined as a line parallel to the implement 104.

It can be understood by those skilled in the art that the first horizontal coordinate axis 304 and the second horizontal coordinate axis 306 will change orientation with respect to a fixed coordinate system as the implement 104 changes orientation. As the first and second horizontal coordinate axes 304,306 change orientation, the angles h and i may change in value. It is known to those skilled in the art that the angles of inclination at any position and orientation on a laser plane 124 may be determined by a number of methods with respect to a global or reference positioning system.

In FIG. 3, the first, second, and third sets of laser detectors 118,120,122 are shown intersecting the laser plane 124. In the preferred embodiment shown in FIGS. 3 and 4, the first set of laser detectors 118 and the second set of laser detectors 120 are mounted on the mast 308 so that a plane defined by their position is perpendicular to the implement 104. The third set of laser detectors 122 is mounted on the mast 308 so that a plane defined by its position relative to the first set of laser detectors 118 is parallel to the implement 104.

It can be appreciated by those skilled in the art that the plane defined by the first set of laser detectors 118 and the second set of laser detectors 120 may be oriented at an angle offset from perpendicular to the implement 104 if the angle of offset is factored into the present invention. In addition, the plane defined by the first set of laser detectors 118 and the third set of laser detectors 122 may be oriented at an angle offset from parallel to the implement 104 if the angle of offset is factored into the present invention.

The first, second, and third sets of laser detectors 118, 120,122 are mounted to the mast 308 in a triangular arrangement, such that the first set of laser detectors is located on a right angle corner of the triangle. In addition, in the preferred embodiment each detector in the first set of laser detectors 118 has a corresponding detector in the second set of laser detectors 120 and a corresponding detector in the third set of laser detectors 122. It should be noted, however, that the detectors in the first, second, and third sets of laser detectors 118,120,122 may be arranged so that they do not correspond to each other without deviating from the scope of the invention.

When the mast 308 is vertical, the corresponding detectors in the first, second, and third sets of laser detectors are horizontally opposed to each other. Also, the first and second sets of laser detectors 118,120 are spaced a known distance b apart, and the first and third sets of laser detectors 118,122 are spaced a known distance g apart.

Referring to FIG. 2, a computer 202 is included to receive signals from the first, second, and third sets of laser detectors 118,120,122. The computer 202 compares the signals received from the first set of laser detectors 118 and the second set of laser detectors 120 and responsively determines an angle of pitch of the implement 104. The angle of pitch is shown as d in FIGS. 3 and 5.

The computer 202 also compares the signals received from the first set of laser detectors 118 and the third set of laser detectors 122 and responsively determines an angle of slope of the implement 104. The angle of slope is shown as f in FIGS. 3 and 6.

The determination of the angles of pitch and slope is discussed in more detail below.

A display 204 electrically connected to the computer 202 receives information concerning the pitch and slope of the implement 104 and displays the information to an operator. The display 204 may be any of a variety of types, including, but not limited to, a monitor, an LED or LCD display, and the like. The display 204 may also be numeric, graphic, or a combination of both.

With reference to FIGS. 3, 5, 6, and 7, the method of determining the pitch and slope of an implement 104 is discussed.

Figure 7:
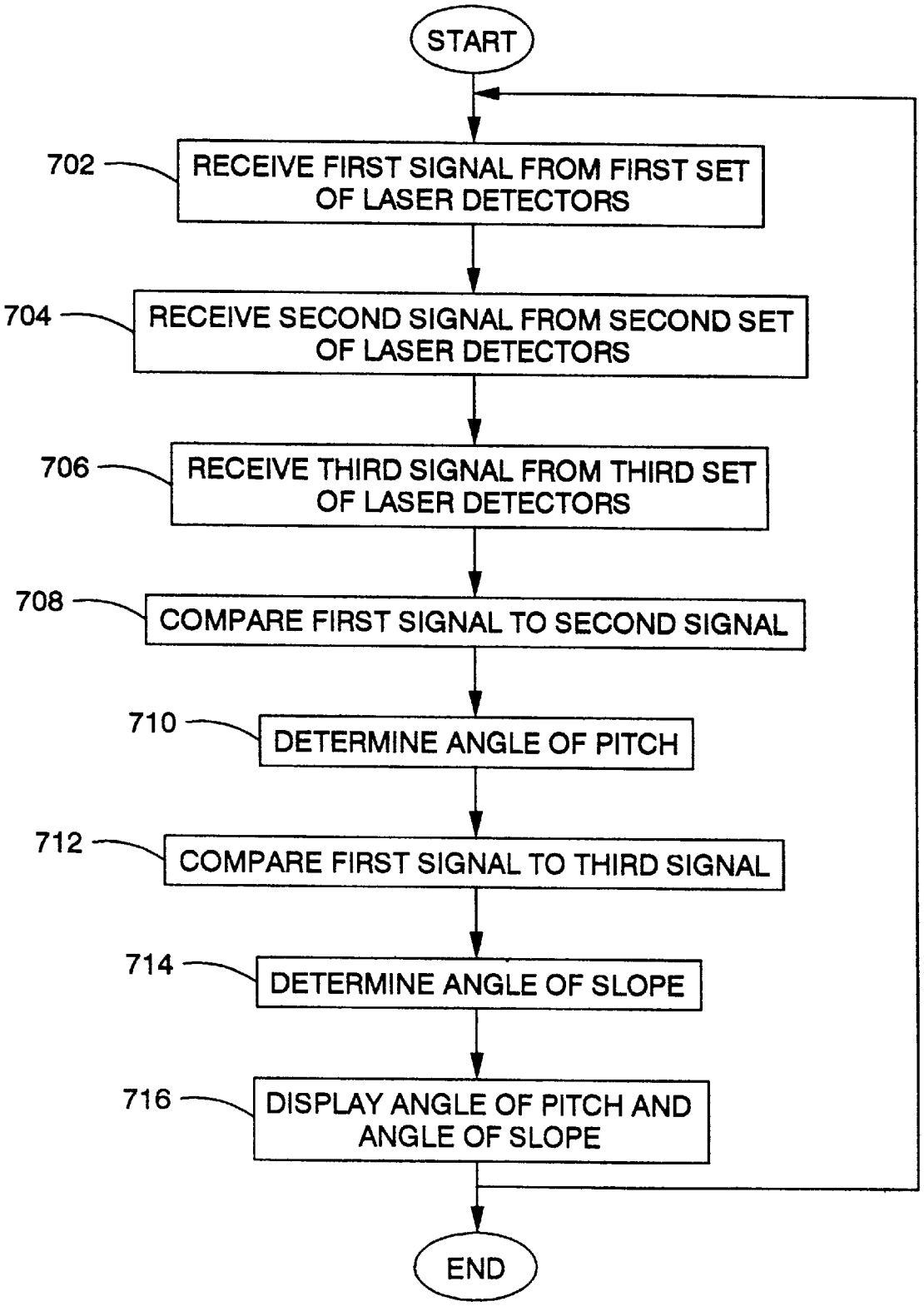
FIG. 7 is a flowchart illustrating one aspect of the present invention.

Referring to FIG. 7, in a first control block 702, a second control block 704, and a third control block 706 the computer 202 receives a first signal from a first set of laser detectors 118, receives a second signal from a second set of laser detectors 120, and receives a third signal from a third set of laser detectors 122, respectively. The signals received from the first, second, and third sets of laser detectors 118,120,122 indicate which detector in each set of laser detectors 118,120,122 is intersecting the laser plane 124.

For example, in FIG. 3, the first set of laser detectors 118 intersects the laser plane 124 at a distance c from the lowest detector. The second set of laser detectors 120 intersects the laser plane 124 at a distance a from the lowest detector. The third set of laser detectors 122 intersects the laser plane 124 at a distance e from the lowest detector.

In a fourth control block 708 the computer 202 compares the signal received from the first set of laser detectors 118 to the signal received from the second set of laser detectors 120. Control then proceeds to a fifth control block 710, where the computer 202 determines the angle of pitch d of the implement 104.

The angle of pitch is determined by using the following trigonometric expression:

$$d=\tan^{-1}(b/(c-a))\pm h \qquad \text{Equation 1}$$

where b is the known distance separating the first set of laser detectors 118 from the second set of laser detectors 120, c−a is the difference in distances from the lowest laser detectors to the laser detectors intersecting the laser plane 124 in the first and second sets of laser detectors 118,120, respectively, and h is the angle of inclination of the laser plane 124 to horizontal as determined along the first horizontal coordinate axis 304 defined as a line perpendicular to the implement 104.

In a sixth control block 712 the computer 202 compares the signal received from the first set of laser detectors 118 to the signal received from the third set of laser detectors 122. Control then proceeds to a seventh control block 714, where the computer 202 determines the angle of slope f of the implement 104.

The angle of slope is determined by using the following trigonometric expression:

$$f=\tan^{-1}(g/(e-c))\pm i \qquad \text{Equation 2}$$

where g is the known distance separating the first set of laser detectors 118 from the third set of laser detectors 122, e−c is the difference in distances from the lowest laser detectors to the laser detectors intersecting the laser plane 124 in the first and third sets of laser detectors 118,122, respectively, and i is the angle of inclination of the laser plane 124 to horizontal as determined along the second horizontal coordinate axis 306 defined as a line parallel to the implement 104.

In an eighth control block 716 the angle of pitch d and the angle of slope f are displayed to an operator. Control then returns to the first control block 702.

INDUSTRIAL APPLICABILITY

As one example of an application of the present invention, a motor grader is often used to grade a work site to a desired finished contour. During operation of the motor grader, it is necessary to orient the implement 104 with respect to the earthmoving machine 102.

For example, it may be necessary to adjust the fore to aft pitch of the implement 104 to modify the load pushing characteristics of the motor grader. The operator would need to know the angle of the pitch of the implement 104. Using the present invention, the angle of pitch d is determined with respect to horizontal, and the direction of the pitch of the implement 104 (fore or aft) is also determined.

Using Equation 1 and referring to FIG. 3, if b is 100, a is 80.75, c is 110, and h is 5, then the angle of pitch d is determined to be 78.69°. As described in the spec, the angle of pitch d is 11.31° forward of vertical.

If a is 110 and c is 80.75, then the angle of pitch d is computed to be −78.69°. As described in the spec, the angle of pitch d is 11.31° aft of vertical.

Using the present invention, the side to side slope f (right or left side raised) can be found in a similar manner.

Other aspects, objects, and features of the present invention can be obtained from a study of the drawings, the disclosure, and the appended claims.

I claim:

1. An apparatus for determining the fore to aft pitch of an implement on an earthmoving machine, the implement having a front surface and a back surface, and two end portions, comprising:

a vertical mast having a first end portion and a second end portion, said first end portion being attached to an end portion of said implement;

a first laser receiver having a first set of laser detectors, said first set of laser detectors being arranged in a column and being attached to said second end portion of said vertical mast;

a second laser receiver having a second set of laser detectors, said second set of laser detectors being arranged in a column and being attached to said second end portion of said vertical mast; and a computer being adapted to receive signals from said first set of laser detectors and said second set of laser detectors, and to compare a first signal from said first set of laser detectors to a second signal from said second set of laser detectors and responsively determine an angle of pitch of said implement.

2. An apparatus, as set forth in claim 1, for determining the side to side slope of said implement, including:

a third laser receiver having a third set of laser detectors, said third set of laser detectors being arranged in a column and being attached to said second end portion of said vertical mast; and said computer being adapted to receive signals from said third set of laser detectors, and to compare said first signal from said first set of laser detectors to a third signal from said third set of laser detectors and responsively determine an angle of slope of said implement.

3. An apparatus, as set forth in claim 1, wherein said first set of laser detectors and said second set of laser detectors are horizontally opposed to each other in a plane substantially perpendicular to the front and back surfaces of said implement.

4. An apparatus, as set forth in claim 1, wherein said first set of laser detectors and said third set of laser detectors are horizontally opposed to each other in a plane substantially parallel to the front and back surfaces of said implement.

5. An apparatus, as set forth in claim 1, wherein said first set of laser detectors is spaced a known distance from said second set of laser detectors and from said third set of laser detectors, respectively.

6. An apparatus, as set forth in claim 1, wherein each detector in said first set of laser detectors has a corresponding detector in said second set of laser detectors, and a corresponding detector in said third set of laser detectors.

7. An apparatus, as set forth in claim 1, including a display electrically connected to said computer.

8. A method for determining the fore to aft pitch of an implement on an earthmoving machine, the implement having a front surface and a back surface, including the steps of:

receiving a first signal from a first set of laser detectors;

receiving a second signal from a second set of laser detectors;

comparing said first signal and said second signal; and determining an angle of pitch responsive to said first signal and said second signal.

9. A method, as set forth in claim 8, for determining the side to side slope of said implement, including the steps of:

receiving a third signal from a third set of laser detectors;

comparing said first signal and said third signal; and determining an angle of slope responsive to said first signal and said third signal.

10. A method, as set forth in claim 9, including the step of displaying at least one of said angle of pitch and said angle of slope.

11. An earthmoving machine, comprising:

an earthmoving implement;

a mast attached to said earthmoving implement;

a first set of at least one laser detectors attached to said mast;

a second set of at least one laser detectors attached to said mast; and a computer operably coupled to said first and second sets of at least one laser detectors, said computer configured to determine an angle of pitch of said earthmoving implement based on signals received from said first and second sets of at least one laser detectors.

12. An earthmoving machine as recited in claim 11, further comprising:

a third set of at least one laser detectors attached to said mast;

wherein said computer is configured to determine an angle of slope of said earthmoving implement based on signals received from said third set of at least one laser detectors and said first set of at least one laser detectors.

* * * * *